US005770929A

United States Patent [19]

Nohara

[11] Patent Number: 5,770,929

[45] Date of Patent: Jun. 23, 1998

[54] ELECTRIC POWER SOURCE ASSEMBLY FOR FOCUSING ELECTRODE OF COLOR CATHODE RAY TUBE APPARATUS

[75] Inventor: Shinji Nohara, Nagasaki, Japan

[73] Assignee: Mitsubishi Denki Kabushiki Kaisha, Tokyo, Japan

[21] Appl. No.: 519,135

[22] Filed: Aug. 24, 1995

[30] Foreign Application Priority Data

Feb. 14, 1995 [JP] Japan ..... 7-025339

[51] Int. Cl.[6] ..... G09G 1/04; H01J 29/46

[52] U.S. Cl. ..... 315/382; 315/14; 313/414

[58] Field of Search ..... 315/382, 382.1, 315/14; 313/414; 348/806, 809

[56] References Cited

U.S. PATENT DOCUMENTS 3,766,429 10/1973 Vincent et al. ..... 315/382.1
4,886,999 12/1989 Yamane et al. ..... 313/414
4,935,663 6/1990 Shimoma et al. ..... 313/412
5,532,547 7/1996 Park et al. ..... 313/414

FOREIGN PATENT DOCUMENTS 563950 1/1981 Japan .
1-236553 9/1989 Japan .

*Primary Examiner*—Gregory C. Issing

[57] ABSTRACT

An electric power source assembly supplies the focusing electrodes of a color cathode ray tube. Such a color cathode ray tube normally includes three electron guns arranged in a line transverse to their beam path. The focusing voltages supplied the focusing electrodes associated with the three guns are independently adjusted to compensate for beam distortion caused by positional differences in gun location. The D.C. and A.C. voltage to the static and or dynamic electrodes is independently controlled to improve beam focus of each individual gun.

20 Claims, 6 Drawing Sheets

ELECTRIC POWER SOURCE ASSEMBLY FOR FOCUSING ELECTRODE OF COLOR CATHODE RAY TUBE APPARATUS

FIELD OF THE INVENTION

This invention relates to an electric power source assembly for focusing electrodes of a color cathode ray tube apparatus, and more particularly to an improvement of the electric power source assembly for a Dynamic Beam Focus electrode (hereafter called DBF electrode).

BACKGROUND OF THE INVENTION

As well known, a color cathode ray tube apparatus using a shadow mask is usually provided with three electron gun assemblies of the in-line type, which produce self-converging beams by utilizing non-uniform deflecting magnetic fields. Such deflecting magnetic fields employ pin-cushion type magnetic field distribution horizontally and barrel type magnetic field distribution vertically.

This type of cathode ray tube, however, causes the distortion of the electron beam spot since the deflection is greater at the peripheral region of the screen than at the center, resulting in lowering of the screen resolution.

FIG. 7 illustrates an example of the DBF electrode used in the conventional cathode ray tube as shown in page 20 of January 1988 edition in Japanese periodical "Television Technology".

In FIG. 7 the operation of the three focusing electrodes 10A, 10B, and 10C for Red, Green and Blue colors is illustrated. Each focusing electrode 10A, 10B, and 10C is divided into four segments respectively, to form a so called "quadrupole lens", and two differing voltages are applied thereto. Namely, each focusing electrode 10A, 10B, 10C is formed by vertical electrodes (static electrodes) 1*a*1, 1*a*2, 1*b*1, 1*a*2, and 1*c*1, 1*c*2 and horizontal electrodes (dynamic electrodes) 2*a*1, 2*a*2, 2*b*1, 2*b*2 and 2*c*1, 2*c*2, so as to apply different voltages across the respective vertical and horizontal electrodes.

The electron beam 30 is emitted from the cathode 28 of the electron gun and is focused by the focusing electrode 10B to make the beam spot 31 for the green color on the screen. Likewise, electron beams are also emitted from the cathodes 27 and 29 of the other electron guns and deflected by the focusing electrodes 10A and 10C to make the other beam spots (not shown).

FIG. 8 illustrates a circuit for applying voltages to the focusing electrodes 10A, 10B and 10C shown in FIG. 7. In FIG. 8, the dynamic electrodes 2*a*1, 2*a*2, 2*b*1, 2*b*2, 2*c*1, and 2*c*2 are supplied AC voltage ΔV by AC power source 4 through lines 11 to 16 connected between coupling condenser 3 and the earth E. The AC voltage ΔV is superimposed on DC voltage Efa formed by dividing a supply voltage from DC power source FBT using variable resistor 5.

The static electrodes 1*a*1, 1*a*2, 1*b*1, 1*b*2, 1*c*1, and 1*c*2, on the other hand, are supplied DC voltage Efb through lines 17 to 110. DC voltage Efb is divided from the supply voltage from DC power source FBT by using a variable resistor 6 through which the power source FTB is applied.

The electron beams are emitted by three electron guns arranged in line with each other, and are deflected or focused by the deflecting magnetic field generated by means of a yoke coil (not shown in the drawing). The deflecting magnetic field is non-uniformly distorted both vertically and horizontally as explained above, thereby performing self-convergence of the three electron beams.

Conventional color cathode ray tube apparatus of the self-convergence type, however, exhibit a problem in that defocus of the electron beam spot occurs due to the deflection increases at the peripheral region of the screen, causing the resolution of the screen in these areas to be reduced. This phenomenon is caused by the fact that the electron beams deflected by the self-convergence type deflecting yoke generate an astigmatism based on the lens function due to the deflecting operation.

In order to cancel the astigmatism, techniques for performing beam deformation before the electron beam is deflected by the deflecting yoke are known; that is, the beam deformation is achieved by controlling the voltage potential of the dynamic electrodes 2*a*1, 2*a*2, 2*b*1, 2*b*2 and 2*c*1, 2*c*2, and the static electrodes 1*a*1, 1*a*2, 1*b*1, 1*b*2 and 1*c*1, 1*c*2 individually.

The static electrodes 1*a*1, 1*a*2, 1*b*1, 1*b*2 and 1*c*1, 1*c*2 have a strong forming controllability mainly along the x-axis of the beam spot, while the dynamic electrodes 2*a*1, 2*a*2, 2*b*1, 2*b*2 and 2*c*1, 2*c*2 have a strong forming controllability mainly along the y-axis of the beam spot. Consequently, the beam defocus in a single beam, may be canceled by properly controlling the static electrode voltage against horizontal defocusing and the dynamic electrode voltage against vertical defocusing to get correct focusing.

In the conventional color cathode ray tube apparatus, however, because the static electrode voltage and dynamic electrode voltage are commonly applied to each electrode 10A, 10B and 10C through only two common lead lines Lh, Lv as explained above, it has been found that beam defocus was not completely canceled, due to the positional discrepancy between the plural electron guns arranged in a horizontal line. This positional discrepancy causes different magnetic field deflection from gun to gun. In other words, the positional discrepancy causes the deflection yoke to perform different lens functions on the R,G, and B beams.

In more detail, in a case in which the G beam is standardized, the R beam results in overfocusing at the right side of the screen (in front view), and in underfocusing at the left side. On the other hand, the B beam results in underfocusing at the right side of the screen and overfocusing at the left side. As used herein, overfocusing means insufficient dynamic voltage, and underfocusing means excessive dynamic voltage. This unavoidable phenomenon could not heretofore be corrected as if either one of the R,G,B guns was focused accurately, the other guns were inevitably even more defocused.

Moreover, the above tendency was further promoted by the scattering in manufacturing of the electron gun. It was, therefore, very difficult for all R,G,B beams to be correctly focused at the full area of the screen.

SUMMARY OF THE INVENTION

Accordingly, an object of the present invention is to provide a color cathode ray tube apparatus capable of controlling the R,G,B beams independently to get correct focusing of all beams.

Another object of the invention is to provide an electric power source assembly for focusing electrodes of the color cathode ray tube apparatus.

A further object is to provide an electric power source assembly for the DBF electrodes capable of controlling independently either or both focusing components in Y-axis direction or X-axis direction of each of the R,G,B beams.

A still another object of the invention is to provide an electric power source assembly for the DBF electrodes capable of controlling independently both outer beams of R,G,B guns and the center beam thereof in either or both of the Y-axis direction and X-axis direction.

These and other objects of the present invention will become more fully apparent from the detailed description presented hereinbelow and the attached drawings which are illustrative of preferred embodiments of the present application.

DETAILED DESCRIPTION OF THE PREFERRED EMBODIMENTS

Figure 1:
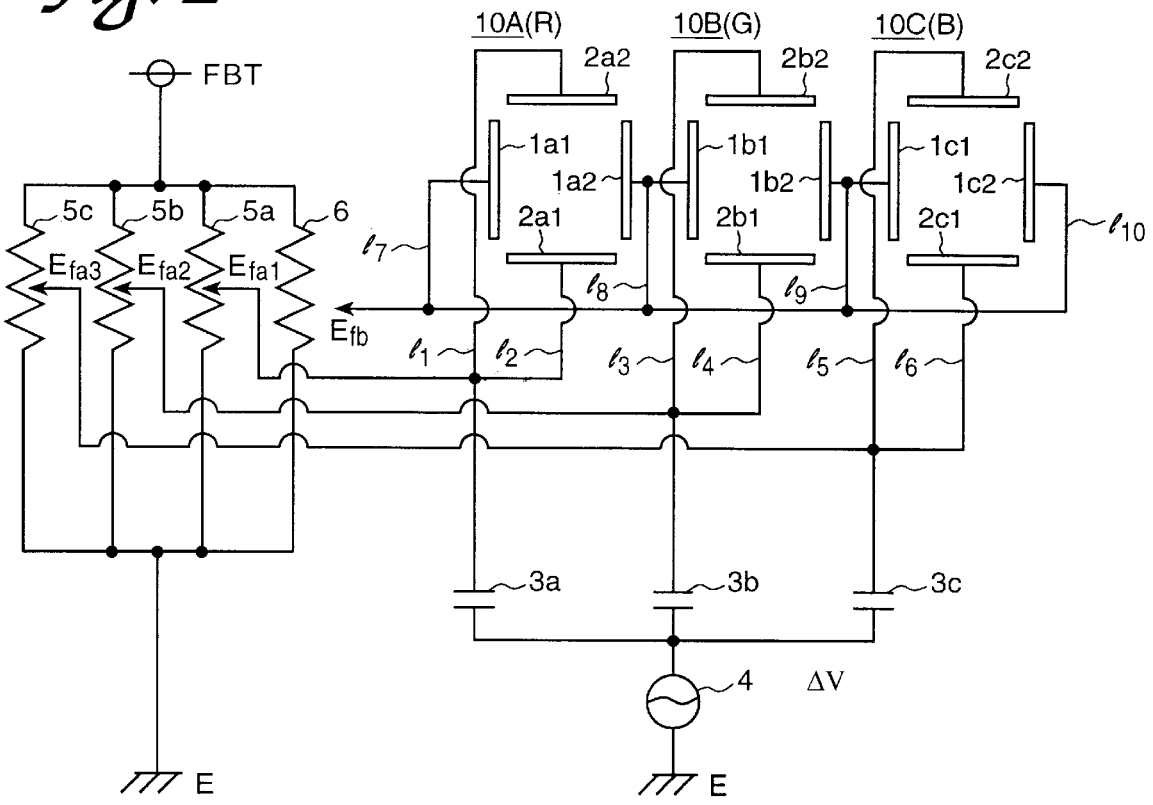
FIG. 1 is a schematic diagram showing an electric power source assembly for focusing electrodes of a color display monitor of a first embodiment of the invention.

Various embodiments of the present invention will be described below with reference to the accompanying drawings wherein like elements in plural figures bear like reference numerals.

FIG. 1 is a schematic diagram showing a circuit configuration in the first embodiment of the focusing electrodes of a color display monitor.

Referring to FIG. 1, each focusing electrode set 10A, 10B and 10C for red, green and blue color (R,G,B), respectively, is formed by static electrodes 1*a*1, 1*a*2, 1*b*1, 1*a*2, and 1*c*1, 1*c*2 and dynamic electrodes 2*a*1, 2*a*2, 2*b*1, 2*b*2 and 2*c*1, 2*c*2. The static electrodes 1*a*1, 1*a*2, 1*b*1, 1*b*2, 1*c*1, 1*c*2 are commonly supplied DC voltage Efb through lines 17 to 110. DC voltage Efb is divided from the supply voltage developed by DC power source FBT by using a variable resistor 6 through which the supply voltage form the power source FTB is applied in a manner similar to that of FIG. 7.

On the other hand, the dynamic electrodes 2*a*1, 2*a*2, 2*b*1, 2*b*2, 2*c*1, and 2*c*2 are applied AC voltage ΔV by an AC power source 4 via coupling condensers 3*a*, 3*b* and 3*c* superimposed on DC voltages Efa1, Efa2 and Efa3. DC voltage Efa1, Efa2 and Efa3 are respectively divided by variable resistors 5*a*, 5*b* and 5*c* from the supply voltage obtained from DC power source FBT. In operation, three DC voltages Efa, Efb and Efc are separately applied to DBS electrodes 10A, 10B and 10C through lines 11, 12, 13, 14 and 15, 16, respectively.

Upon adjusting each variable resistor 5*a*, 5*b* and 5*c*, DC voltage applied to each dynamic electrode 2*a* (2*a*1, 2*a*2), 2*b* (2*b*1, 2*b*2) and 2*c* (2*c*1, 2*c*2) is independently controlled so that each beam R,G,B is focused to an optimum position, respectively. This embodiment enables, therefore, Y direction components of all R,G,B beams to be correctly focused over all areas of the screen.

Figure 2:
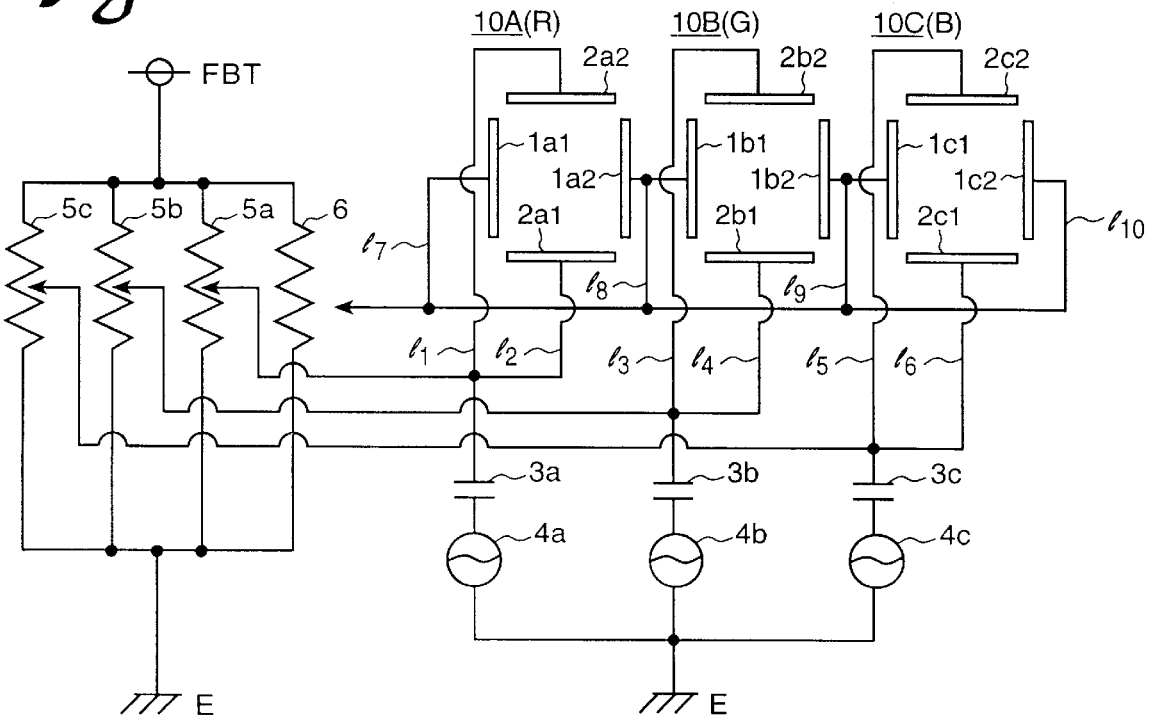
FIGS. 2 to 6 are schematic diagrams of second to sixth embodiments of the present invention, respectively, showing an electric power source assembly for focusing electrodes of a color display monitor.

FIG. 2 illustrates a second embodiment of the present invention. The reference numerals in FIG. 2 that are identical to those in FIG. 1 represent identical or similar parts to those in FIG. 1. The second embodiment differs from the first embodiment in the configuration of the AC voltage sources 4*a*, 4*b* and 4*c*.

In FIG. 2, the AC voltage sources 4*a*, 4*b* and 4*c* are capable of being controlled to independently vary the value of their voltages, respectively. This embodiment also enables, therefore, Y direction components of all R,G,B beams to be correctly focused over all areas of screen with even more accuracy.

Figure 3:
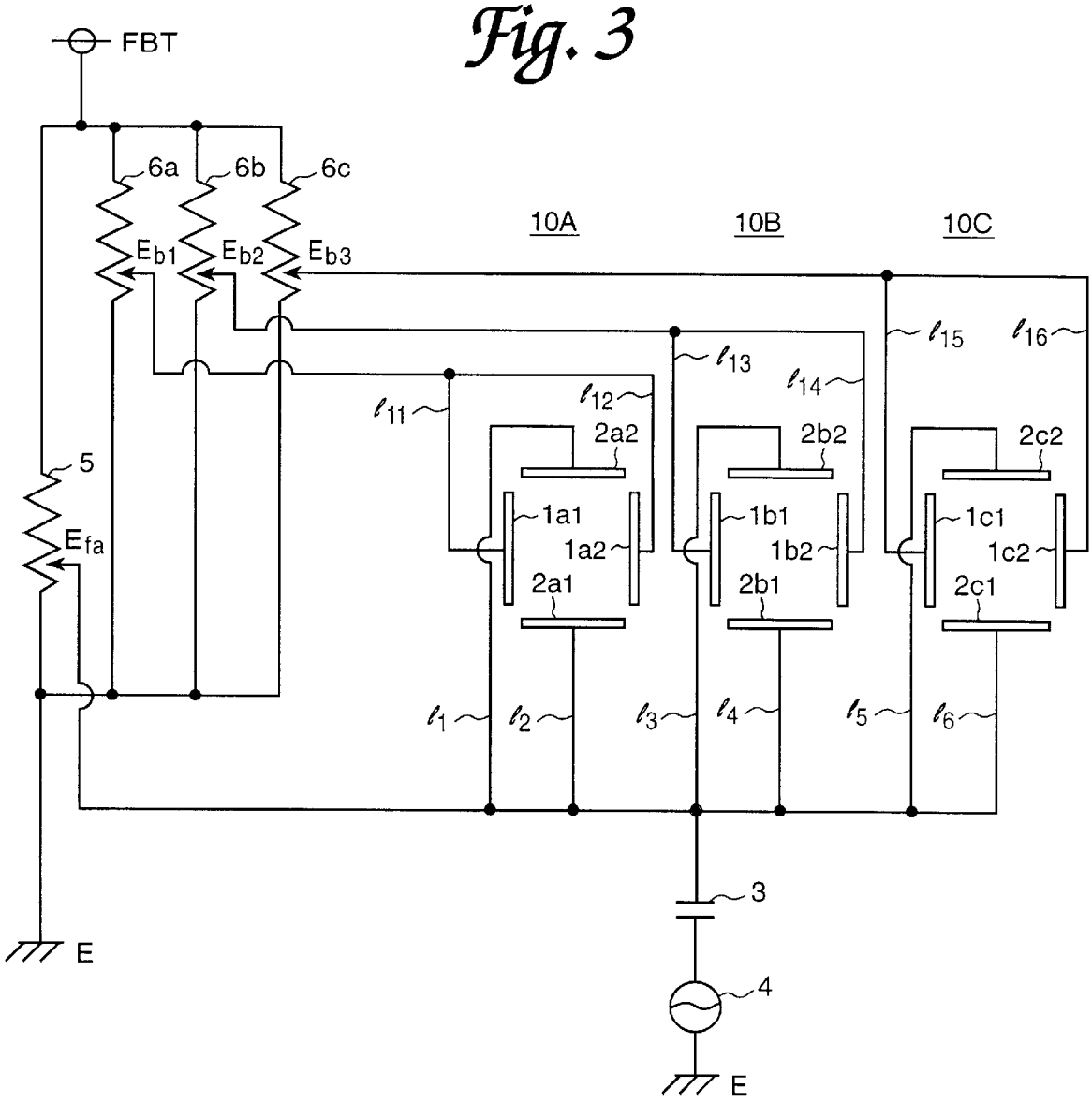

FIG. 3 illustrates a third embodiment of the invention.

Referring to FIG. 3, the AC power source 4 and DC voltage Efa divided from DC power source FBT by variable resistor 5 are superimposedly applied to each dynamic electrodes 2*a* (2*a*1, 2*a*2), 2*b* (2*b*1, 2*b*2), 2*c* (2*c*1, 2*c*2) through lines 11 to 16.

However, static electrodes 1*a* (1*a*1, 1*a*2), 1*b* (1*b*1, 1*b*2), 1*c* (1*c*1, 1*c*2) are separately applied DC voltages Efb1, EFb2 and Efb3 through lines 111 to 116, which DC voltages Efb1, Efb2 and Efb3 are respectively divided by variable resistors 6*a*, 6*b* and 6*c* from the supply voltage of the power supply FBT.

The third embodiment differs from the first and second embodiments in configuration in that the DC voltage applied to each static electrode 1*a* (1*a*1, 1*a*2), 1*b* (1*b*1, 1*b*2) and 1*c* (1*c*1, 1*c*2) is independently controlled instead of those voltages supplied to the dynamic electrodes. Therefore, upon adjusting each variable resistor 6*a*, 6*b* and 6*c*, each beam R,G,B is focused on an optimum position, respectively.

This embodiment enables, therefore, X-direction components of all R,G,B beams to be correctly focused over all areas of the screen.

Figure 4:
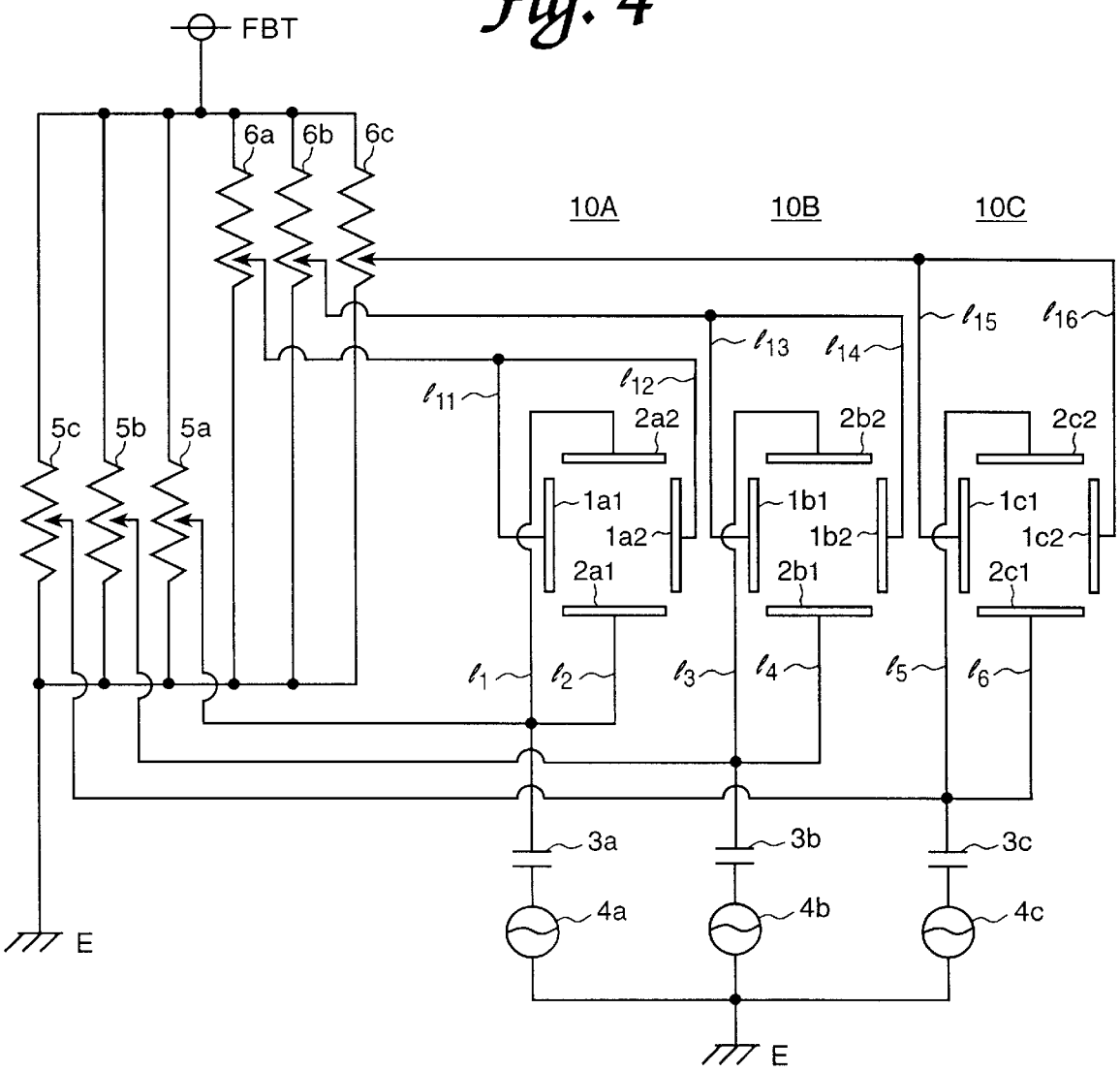
Figure 5:
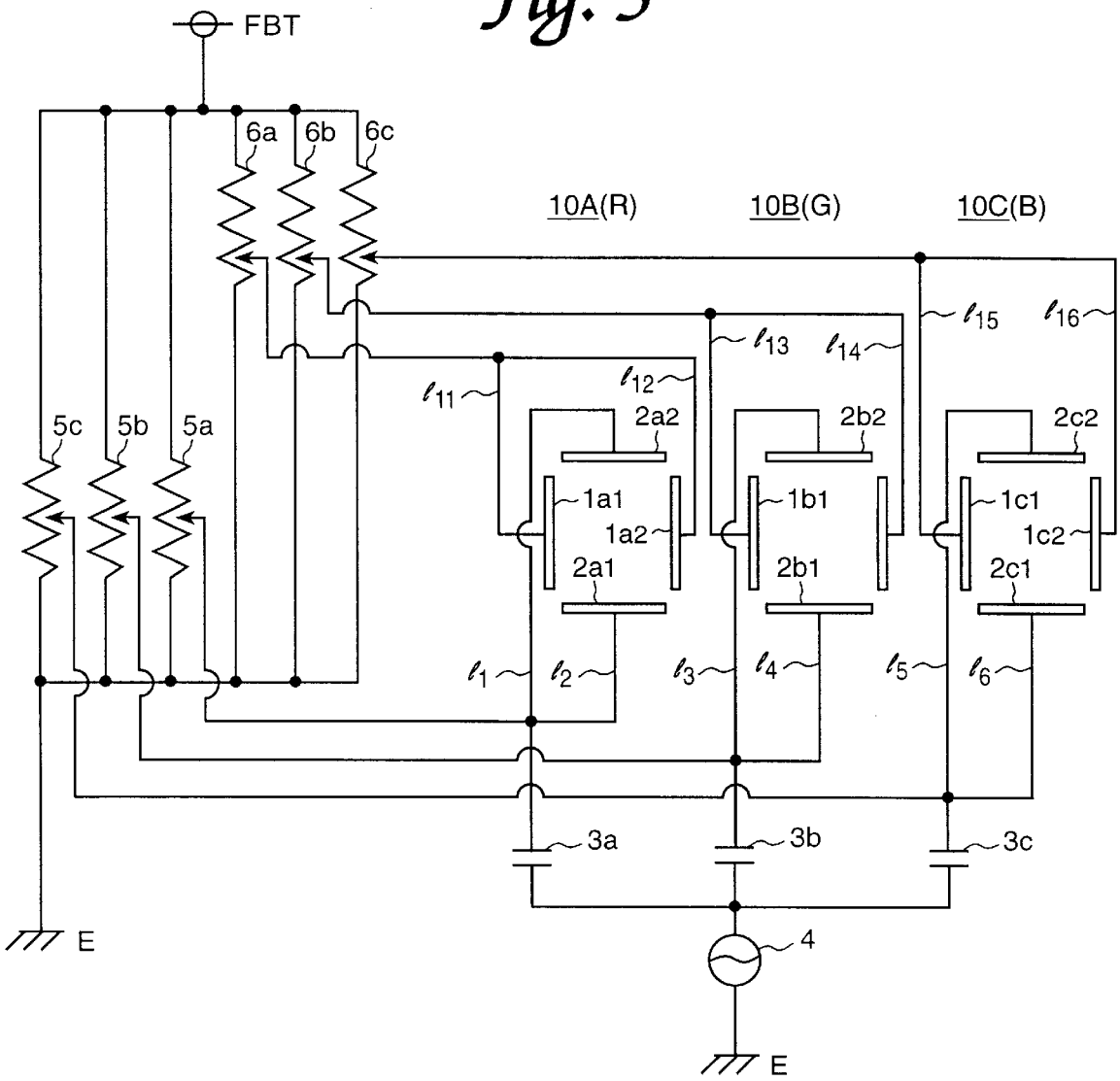

The third embodiment can be modified by combining with the first or second embodiment as shown in FIG. 4 and FIG. 5.

FIG. 4 illustrates a fourth embodiment which is a combination of the second and third embodiments, and FIG. 5 illustrates a fifth embodiment which is a combination of the first and third embodiments.

The operation is self-explanatory, therefore, it is easily understood that these embodiments enable, both X and Y-direction components of all R,G,B beams to be correctly focused over all areas of the screen.

Figure 6:
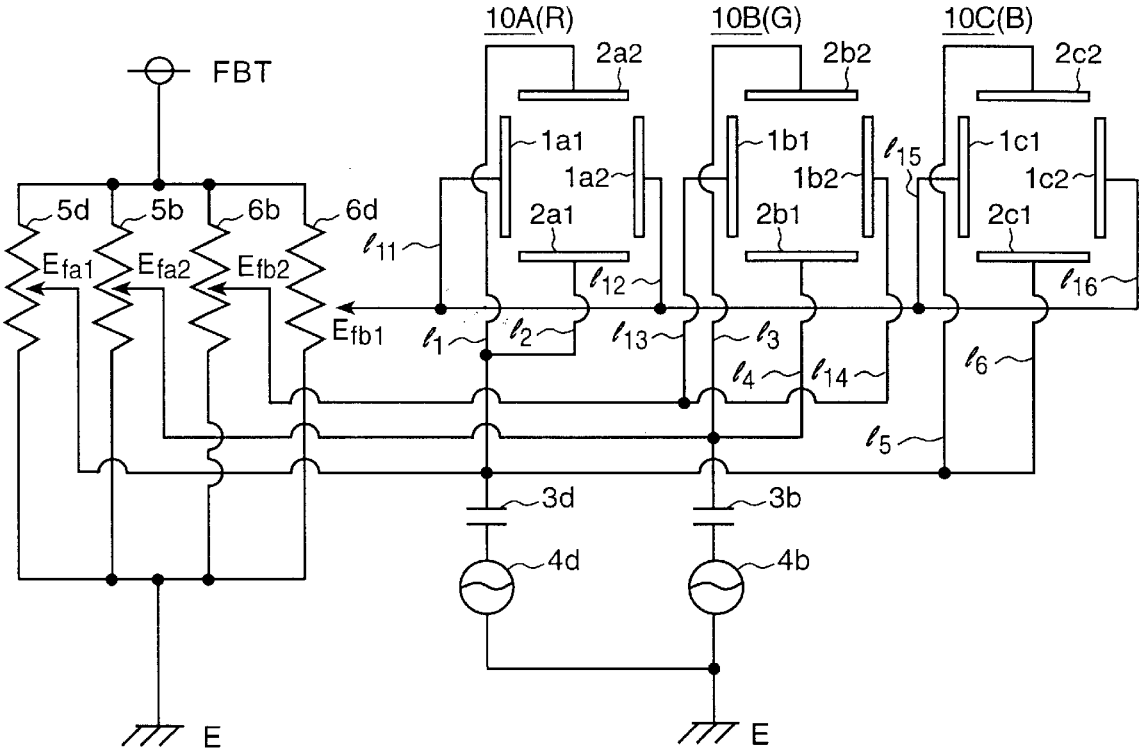

Finally, FIG. 6 illustrates a sixth embodiment of this invention. In FIG. 6, the static electrodes 1*a*1, 1*a*2, 1*c*1, 1*c*2 are supplied DC voltage Efb1 through lines 111, 112 and 115, 116. Common DC voltage Efb1 is divided by a variable resistor 6*d* to which the supply voltage from power source FTB is applied, while the static electrodes 1*b*1, 1*b*2 are supplied DC voltage Efb2 through lines 113, 114; DC voltage Efb2 being divided by a variable resistor 6*b* from the supply voltage from power source FTB.

On the other hand, the dynamic electrodes 2*a*1, 2*a*2 are supplied the superimposed voltage of AC power source 4*d* and DC voltage Efa1 through lines 11, 12. This voltage is developed by dividing the supply voltage from power source FTB by variable resistor 5*d*. The dynamic electrodes 2*b*1, 2*b*2 are supplied a superimposed voltage of AC power source 4*b* and DC voltage Efa2 through lines 13, 14. This voltage is developed by dividing the supply voltage from the power source FTB by variable registers 5*b*. Further, the dynamic electrodes 2*c*1, 2*c*2 are supplied DC voltage Efa1 through lines 15, 16. DC voltage Efa1 is developed by dividing the supply voltage from the power source FTB divided by variable resistor 5*d*.

The sixth embodiment differs from the fourth embodiment in configuration in that DC voltage Efa1 applied to the dynamic electrodes 2*a* (2*a*1, 2*a*2) and 2*c* (2*c*1, 2*c*2) are commonly provided, and DC voltage Efb1 applied the static electrodes l*a* (1*a*1, 1*a*2) and l*c* (1*c*1, 1*c*2) is commonly provided.

Figure 7:
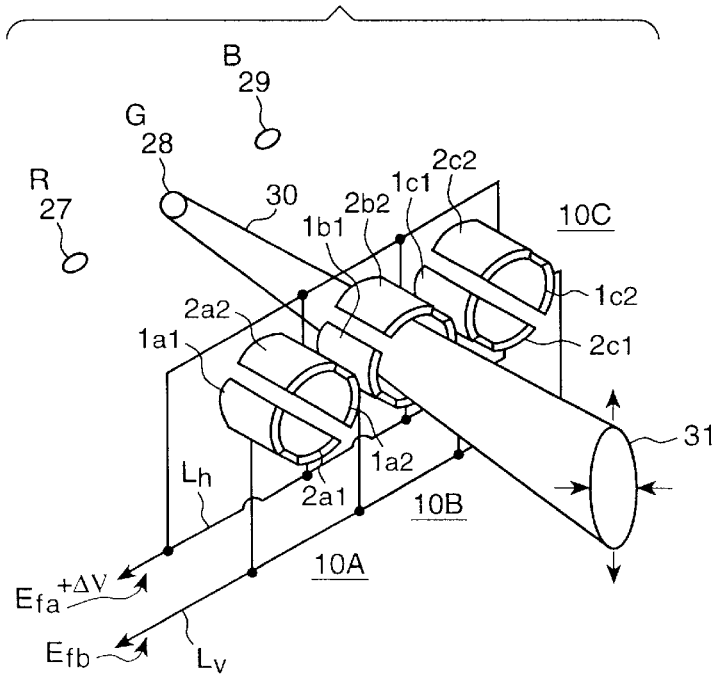
Fig. 7 (PRIOR ART)
FIG. 7 is a schematic drawing for explaining the operation of focusing electrodes of a prior art color display monitor.
Figure 8:
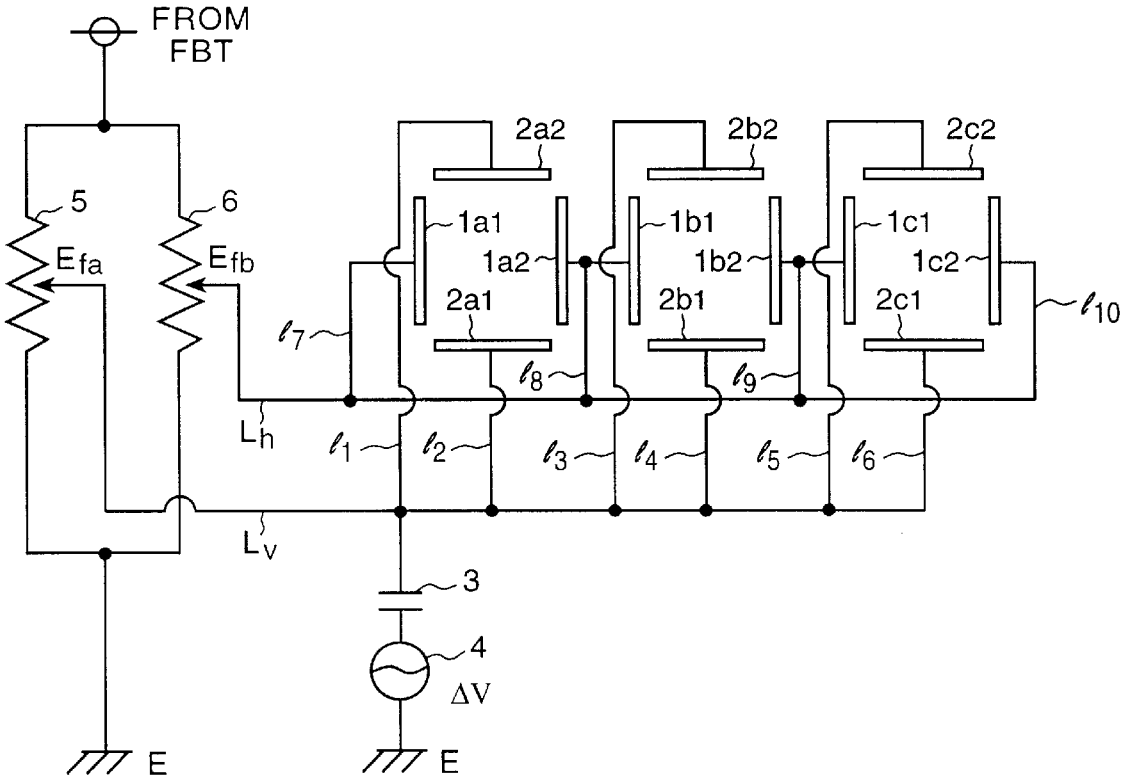
Fig. 8 (BACKGROUND ART)
FIG. 8 is a circuit diagram showing a conventional electric power source assembly for focusing electrodes of a color display monitor.

Those connections would also make sense in practice by the reason that there is a tendency for deflecting or focusing errors at the both ends R and B to be similar to each other, because, as described in FIG. 7, the focusing electrodes 10A, 10B and 10C for R,G,B and the electron guns 27, 28 and 29 for R,G,B are arranged in line, respectively.

The sixth embodiment is capable of reducing the number of parts and getting a smaller size in the assembly compared with the forth embodiment.

In the above explanation on the sixth embodiment, the dynamic electrodes 2*a*, 2*c* and the static electrodes 1*a*, 1*c* are commonly controlled, respectively. However, it is possible, of course, to commonly control only either the dynamic electrodes 2*a*, 2*c* or the static electrodes 1*a*, 1*c*.

Although the present invention has been described and illustrated in detail, it is clearly understood that the same is by way of illustration and example only and is not to be taken by way of limitation, the spirit and scope of the present invention being limited only by the terms of the appended claims.

I claim:

1. An electric power source assembly for focusing electrodes of a color cathode ray tube apparatus, comprising:

a plurality of electron guns;

focusing electrode sets, each associated with a said electron gun, for deflecting and focusing electron beams emitted from said guns; and electric power source circuit, applying a predetermined voltage to said focusing electrodes, said electric power source circuit separately controlling the voltage applied to the focusing electrodes for each electron gun.

2. The electric power source assembly for the focusing electrodes of the color cathode ray tube apparatus of claim 1, wherein each said focusing electrode set comprises a pair of dynamic electrodes and a pair of static electrodes forming a quadruple lens.

3. The electric power source assembly for the focusing electrodes of the color cathode ray tube apparatus of claim 2, wherein said electric power source circuit includes plural DC voltage sources, each independently controlling the voltage supplied to the dynamic electrodes of a said electron gun.

4. The electric power source assembly for the focusing electrodes of the color cathode ray tube apparatus of claim 3, wherein each of said DC voltage sources is connected in parallel with an AC voltage source commonly supplying an A.C. component voltage to each said electron gun.

5. The electric power source assembly for the focusing electrodes of the color cathode ray tube apparatus of claim 3, wherein each of said DC voltage sources is connected in parallel with an AC voltage source which is independently controllable.

6. The electric power source assembly for the focusing electrodes of the color cathode ray tube apparatus of claim 2, wherein said electric power source circuit includes plural DC voltage sources independently controlling the voltages supplied to said static electrodes of each said electron gun.

7. The electric power source assembly for the focusing electrodes of the color cathode ray tube apparatus of claim 2, wherein said electric power source circuit includes plural D.C. voltage sources independently controlling the voltages supplied to both the dynamic electrodes and static electrodes of each said electron gun.

8. The electric power source assembly for the focusing electrodes of the color cathode ray tube apparatus of claim 2, wherein said electric power source circuit includes a plurality of independently controllable DC voltage sources each associated with at least one electron gun and being connected in parallel with plural AC voltage sources to independently supply each electron gun.

9. The electric power source assembly for the focusing electrodes of the color cathode ray tube apparatus of claim 7, wherein said electric power source circuit includes a plurality of independently controllable DC voltage sources each associated with at least one electron gun and being connected in parallel with a common AC voltage source to supply each electron gun.

10. An electric power source assembly for focusing electrodes of a color cathode ray tube apparatus, comprising:

three electron guns arranged in a line transverse to their beam path;

focusing electrode sets, each associated with a said electron gun and including a pair of dynamic electrodes and a pair of static electrodes associated with each said electron gun for deflecting and focusing an electron beam emitted therefrom; and electric power source circuit, applying a predetermined voltage to said focusing electrodes, said electric power source circuit including first and second DC voltage sources, the first D.C. voltage source independently controlling the voltage supplied to the dynamic electrodes of a center one of said electron guns, the second D.C. voltage source independently controlling the voltage supplied to the dynamic electrodes of the remaining two of said electron guns.

11. An electric power source assembly for focusing the electrodes of the color cathode ray tube apparatus of claim 10, wherein each of said DC voltage sources is connected in parallel with an associated one of first and second AC voltage sources, the first A.C. voltage source independently controlling the voltage supplied to electrodes of a center one of said electron guns, the second A.C. voltage source independently controlling the voltage supplied to electrodes of the remaining two of said electron guns.

12. An electric power source assembly for focusing electrodes of a color cathode ray tube apparatus, comprising:

three electron guns arranged in a line transverse to their beam path;

focusing electrode sets, each associated with a said electron gun and including a pair of dynamic electrodes and a pair of static electrodes associated with each said electron gun for deflecting and focusing an electron beam emitted therefrom; and electric power source circuit for applying a predetermined voltage to said focusing electrodes, said electric power source circuit including first and second DC voltage sources, the first D.C. voltage source independently controlling the voltage supplied to the static electrodes of a center one of said electron guns, the second D.C. voltage source independently controlling the voltage supplied to the static electrodes of the remaining two of said electron guns.

13. A color cathode ray tube connectable to an external drive circuit and receiving drive voltages therefrom, comprising:

three electron guns arranged in a line transverse to their beam path;

a magnetic field generating means for deflecting and focusing electron beams emitted from each of said guns;

focusing electrode sets, each associated with a said electron gun and including a pair of dynamic electrodes and a pair of static electrodes associated with each said electron gun for deflecting and focusing an electron beam emitted therefrom; and outlet leads connecting the color cathode ray tube to said external drive circuit, said outlet leads including plural focussing electrode outlet leads connected to at least one of said dynamic electrodes and said static electrodes to allow the focus of at least one of said electron guns to differ from the other of said electron guns.

14. The color cathode ray tube of claim 13 wherein the dynamic electrodes of each said electron gun are provided with independent output leads.

15. The color cathode ray tube of claim 13 wherein the static electrodes of each said electron gun are provided with independent output leads.

16. The color cathode ray tube of claim 13 wherein the dynamic electrodes of a center one of said electron guns are provided with output leads different from the remaining dynamic electrodes.

17. The color cathode ray tube of claim 13 wherein the static electrodes of a center one of said electron guns are provided with output leads different from the remaining static electrodes.

18. A system for focusing the electron beams emanating from the plural electron guns of a color cathode ray tube comprising:

a set of focussing electrodes associated with each said electron gun; and a focusing supply voltage generator supplying focusing voltages to each said set of focusing electrodes, said focussing supply voltage generator supplying different focusing voltages to focusing electrode sets associated with different electron guns.

19. The system of claim 18 wherein said color cathode ray tube includes three electron guns arranged in a line;

said focussing supply voltage generator supplying focusing voltages to the focusing electrodes associated with the center one of said three electron guns which differ, at least in part, from the focusing voltages supplied to the remaining focusing electrodes.

20. The system of claim 18 wherein said color cathode ray tube includes three electron guns arranged in a line;

said focusing supply voltage generator supplying focusing voltages which independently vary, at least in part, to the focusing electrodes associated with each said electron gun.

* * * * *